United States Patent [19]

Deike

[11] Patent Number: 4,574,539

[45] Date of Patent: Mar. 11, 1986

[54] GROUND ANCHOR WITH SCOOP CHANNEL DISCHARGING TO GROOVE FORMING RIDGE

[75] Inventor: Robert F. Deike, Cheyenne, Wyo.

[73] Assignee: Construction Robotics, Inc., Chicago, Ill.

[21] Appl. No.: 660,294

[22] Filed: Oct. 12, 1984

[51] Int. Cl.[4] ..... E02D 5/80

[52] U.S. Cl. ..... 52/163; 52/166

[58] Field of Search ..... 52/156, 163, 166, 162

[56] References Cited

U.S. PATENT DOCUMENTS

| | | |
|---|---|---|
| 631,168 | 8/1899 | Langston . |
| 660,667 | 10/1900 | Swartz . |
| 722,778 | 3/1903 | Wantling . |
| 768,705 | 8/1904 | Swan . |
| 855,298 | 5/1907 | Frost . |
| 936,824 | 10/1909 | Simpson et al. . |
| 972,306 | 10/1910 | Wilcox . |
| 1,014,806 | 1/1912 | Burns et al. . |
| 1,052,700 | 2/1913 | Warrick . |
| 1,245,176 | 11/1917 | Beard . |
| 1,564,069 | 12/1925 | Hoovens . |
| 2,286,976 | 6/1942 | Roberts . |
| 3,066,769 | 12/1962 | Pasquale . |
| 3,375,884 | 4/1968 | Bodine, Jr. . |
| 3,653,167 | 4/1972 | Menard . |
| 3,665,717 | 5/1972 | Sweeney et al. . |
| 3,742,717 | 7/1973 | Wey . |
| 3,888,057 | 7/1975 | Zubke . |
| 3,935,912 | 2/1976 | Shibata . |
| 3,969,853 | 7/1976 | Deike . |
| 3,969,854 | 7/1976 | Deike . |
| 4,044,513 | 8/1977 | Deike . |
| 4,096,673 | 6/1978 | Deike . |

*Primary Examiner*—John E. Murtagh
*Assistant Examiner*—C. Dennison
*Attorney, Agent, or Firm*—Hill, Van Santen, Steadman & Simpson

[57] ABSTRACT

A plate-like ground or earth anchor has a scoop-like channel formed in the leading end thereof, and an open topped socket formed in the trailing end thereof, laterally extending wings along the length thereof, and a raised cable anchor ridge directing dirt from the channel so that a cable or rod secured therein will be free to swing when it is tensioned to pull the plate from an upright driving position to a transverse horizontal locking position. The leading ends of the wings are beveled toward the channel to cooperate therewith for forming a chisel-like leading edge on the plate. The open top of the socket is inclined to provide an apex beyond the wings and a cutting edge merging into the rear ends of the wings which are also beveled to provide cutting edges. The plate is driven upright into the ground by an impact rod loosely fitted in the socket and as it cuts into the ground, it leaves a channel or groove for a cable or tension rod.

16 Claims, 15 Drawing Figures

FIG. 1
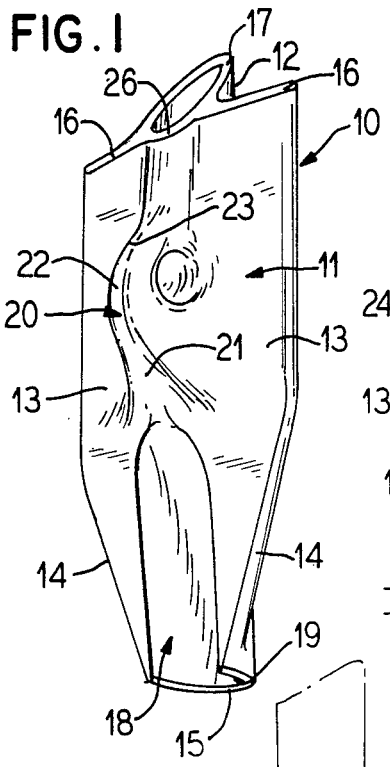
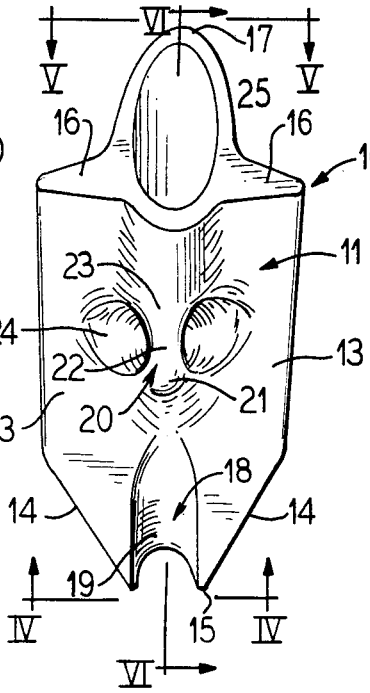
FIG. 2
FIG. 3
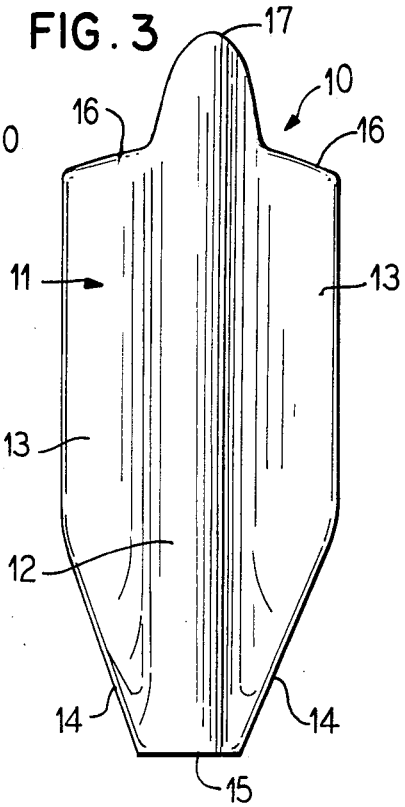
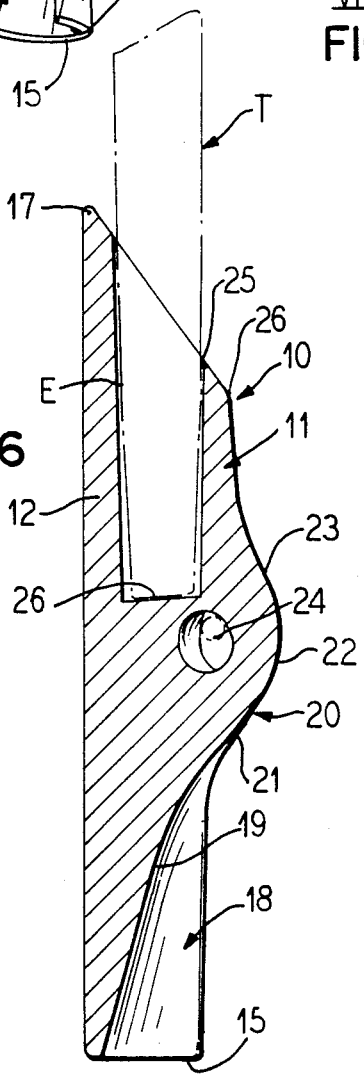
FIG. 6
FIG. 4
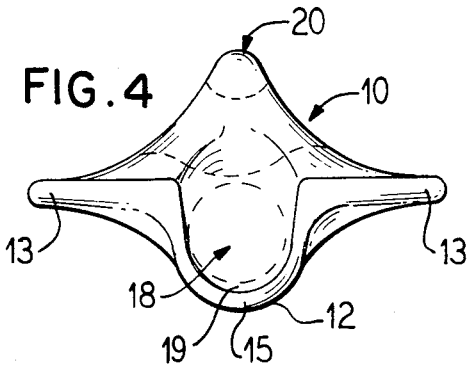
FIG. 5
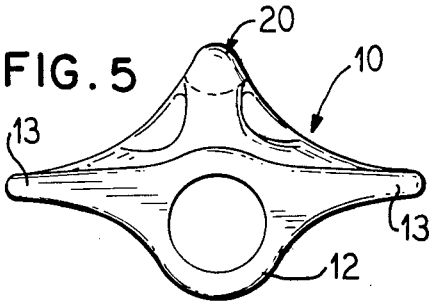

GROUND ANCHOR WITH SCOOP CHANNEL DISCHARGING TO GROOVE FORMING RIDGE

BACKGROUND OF THE INVENTION

1. Field of the Invention

This invention relates to the art of earth or ground anchors inserted lengthwise into the ground and tilted or rotated into anchoring position for presenting wide faces resisting tension loads tending to pull the anchor out of the ground and specifically this invention deals with plate-like ground anchors with a scoop channel on the leading end, an impact tool socket on the trailing end, laterally extending wings between the ends and a cable anchor cooperating with the scoop channel to maintain free swinging of the cable.

2. Description of Related Art

Ground anchors driven upright or edgewise into the ground and then rotated to transverse or horizontal positions in the ground are known for example in my prior U.S. Pat. No. 3,969,854 issued July 20, 1976; U.S. Pat. No. 4,044,513 issued Aug. 30, 1977; and U.S. Pat. No. 4,096,673 issued June 27, 1978. To insure tilting of these anchors into locking positions in the ground, the anchor must be free to swing relative to the cable so that when it has reached its desired depth in the ground and the cable is tensioned, it will tilt or rotate into a locking position.

It is also desirable to provide the anchor with extensive planar face or surface areas to resist being pulled out of the ground from their tilted locked positions. To maintain the free swinging relationship, the anchor of U.S. Pat. No. 3,969,854 was either dropped into a preformed hole or driven into the ground by a member which formed a hole. The open hole above the anchor did not provide any resistance for retracting the anchor and it was necessary therefor to rely on dirt on opposite sides of the hole overlying the anchor after it was swung into its transverse locking position or to pack a filler or concrete into the hole. Further, the tubular anchor disclosed in my U.S. Pat. Nos. 4,044,513 and 4,096,673 did not present appreciable surfaces to resist being pulled out of the ground from their transverse locked positions.

It would therefor be an improvement in this art to provide a plate-like ground anchor driven upright into the ground displacing a minimum amount of earth but forming a restricted channel maintaining a free swinging relationship between the cable and anchor and then presenting wide-wing barriers or surfaces to the ground when rotated into locked position to resist being pulled out of the ground. It would especially be an improvement in the art to provide a curved channel or chisel contour on the leading end of the anchor to maintain it in upright position as it is driven into the ground while plowing the earth away from the cable anchor to maintain the free swinging relationship of the cable and anchor without however forming a large open hole in the ground.

SUMMARY OF THE INVENTION

According to this invention there is provided a plate-type ground anchor which can be a one-piece cast or forged member formed of metal such as steel or aluminum having a thick elongated central longitudinal body with a channel scoop or curved chisel leading end, an open top socket trailing end, and wings radiating laterally from the body along the length thereof. The leading ends of the wings are tapered to the leading chisel edge of the body and are chamfered or beveled to provide additional cutting edges. The open top of the socket is inclined from an apex beyond the trailing ends of the wings to merge with these trailing ends and form additional cutting edges. The body has a longitudinally extending raised cable eye or anchor with a leading end merged into the scoop channel and a trailing end adapted to have the cable freely looped therearound. The socket is tapered inwardly from its open end to a solid bottom about level with the center line of the cable eye receiving the end of an impacting tool such as a hammer driven rod which fits freely in the socket. The taper of the socket prevents dirt from being packed around the driving tool.

The anchor is driven upright or edgewise into the ground with the leading end acting as a chisel to cut the ground. The upright end configuration of the anchor presents minimum surface area so that it is easily driven into the ground in a manner similar to the blades of a post-hole digger or spade but the wings provide an extensive frontal area so that when the anchor is tilted into locking position it will not be pulled out of the ground. Chisel edges provided on both the leading and trailing ends of the anchor facilitate cutting of the ground as the anchor is rotated into locked position and the contour of the cable anchor portion of the body is such as to cut a channel in the ground freely receiving the cable. The center line of the cable eye is slightly rearward of the transverse center of mass of the anchor so that the anchor will tilt downward about 5° to 10° from horizontal when swingably suspended from the cable.

The angle of the inclination of the open top end edge of the socket is preferably 35 to 45 degrees from the vertical axis.

The anchors may be furnished in various sizes to satisfy required load conditions but preferably have a length to width relationship of about two to one to minimize driven drag and maintain an upright driving position.

The full width trailing end portions of the wings should have a greater length than the leading tapered or converging portions in the general relationship of two or three to one.

The taper of the socket need only be several degrees to be sufficient to prevent the rod from sticking in the socket.

Typical anchor sizes will vary in length from 3 to 15 inches and in width from 1 to 4 inches with a leading chisel end depth of ½ to 3 inches and a cable eye anchor height of ½ to 2 inches.

The apex of the inclined open top of the socket may be about ½ to 3 inches beyond the trailing end edges of the wings. The wing thickness may vary from about 1/16 to ¼ inch.

It is an object of this invention to provide improved plate-like ground anchors adapted to be driven upright into the ground with a minimum effort while simultaneously forming a small channel to freely receive a tensioning cable and to be pulled into a tilted horizontal position by the cable for presenting extensive planar surfaces to the ground lying above the anchor.

A further object of this invention is to provide ground anchors for cables, rods and the like which plow into the ground leaving a channel for the cable or rod.

A further object of this invention is to provide a plate-type ground anchor with a curved chisel leading channel end, diverging lateral wings and an open top socket in the trailing end to receive a driving tool.

Another object of the invention is to provide a plate-type ground anchor with an open top driving tool socket on one side thereof, a cable anchor eye on the other side thereof and a curved channel leading end merged into the cable eye.

Other and further objects of this invention will become apparent to those skilled in this art from the following detailed description of best mode embodiments of the invention shown in the attached sheets of drawings.

BRIEF DESCRIPTION OF THE DRAWINGS

FIG. 1 is a front side and edge perspective view of one form of ground anchor of this invention;

FIG. 2 is a front face view of the anchor of FIG. 1;

FIG. 3 is a back face view of the anchor of FIGS. 1 and 2;

FIG. 4 is a leading end edge view of the anchor of FIGS. 1-3 taken along the line IV—IV of FIG. 2;

FIG. 5 is a trailing edge view of the anchor of FIGS. 1 and 2 taken along the lines V—V of FIG. 2;

FIG. 6 is a longitudinal sectional view of the anchor of FIGS. 1 and 2 taken along the lines VI—VI of FIG. 2;

BRIEF DESCRIPTION OF THE PREFERRED EMBODIMENTS

Figure 7:
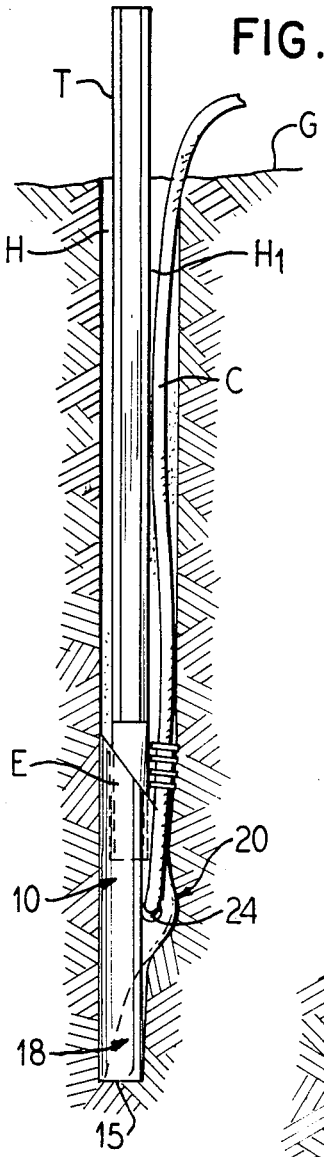
FIG. 7 is a side elevational view showing the manner in which the ground anchor of FIGS. 1 to 6 is driven into the ground and showing the ground surrounding the driven hole in longitudinal section.

The ground anchor 10 of FIGS. 1-6 is a one-piece plate member 11, preferably cast or forged from a metal such as steel or aluminum. The member 11 is generally rectangular in shape having a length at least about twice as long as its width. The member 11 has a back face with a longitudinal central body portion 12 extending the full length thereof and having a rounded, generally fragmental cylindrical cross-section. Thin wings 13,13 extend laterally from the sides of the central body portion 12 and are tapered to relatively thin outer edges. The wings may have a width slightly greater than the width of the body portion 12. The leading ends of the wings are tapered at 14 to converge at the leading end edge 15 of the body portion 12. The tapered portions of the wings may vary in length and in general constitute about one-third the length of the wings. The trailing ends 16 of the wings terminate short of the trailing end 17 of the central body portion 12.

The front face of the plate member 11 has a central channel 18 extending from the leading edge 15. This channel 18 is generally U-shaped in cross-section with the side legs merged into the converging ends of the tapered wing portions 14 and with a round bight bottom 19 sloping from the leading edge 15 upwardly to a central longitudinal ridge 20 extending above the top of the wings 11. The ridge 20 has an upwardly and rearwardly sloping front leg 21 merged into the upper rear end of the channel bottom 19 peaking at a crest 22 and then sloping downwardly and rearwardly along a leg 23 to the level of the wing. A transverse aperture or eye 24 extends through the ridge 20 under the crest 22.

The trailing end of the central longitudinal body portion 12 is hollow with a tapered bore 25 extending from the open top thereof to a solid bottom 26 at a level close to the aperture or eye 24. The open top slopes downwardly and forwardly from the apex 17 to the trailing end of the ridge leg 23 as illustrated at 26. This provides a sloping top edge merged at its lower end with the trailing ends 16 of the wings 13. The angle of inclination or slope is preferably about 35 degrees to 45 degrees from the longitudinal axis of the body portion 12. The taper of the bore 25 need only be a few degrees so that a driving tool T illustrated in FIG. 7 having a tapered end E will fit freely in the bore without wedging, and in the event dirt or sand particles enter the bore they will not be packed thereon to jam the socket and interfere with easy removal of the tool T.

The leading end 15 of the body member, the trailing wing ends 16 and the edge of the inclined socket top are chamfered or bevelled to provide chisel cutting edges.

The eye 24 of the ridge 20 has a cable C looped therethrough. The eye 24 is substantially larger than the cable diameter so that the anchor will swing freely on the looped end of the cable. Since the ridge 20 projects beyond the top face of the plate 11 and the eye 24 is positioned rearwardly from the transverse center of the plate when the anchor is suspended freely on the looped end of the cable, its leading end 15 will tilt downwardly.

Figure 8:
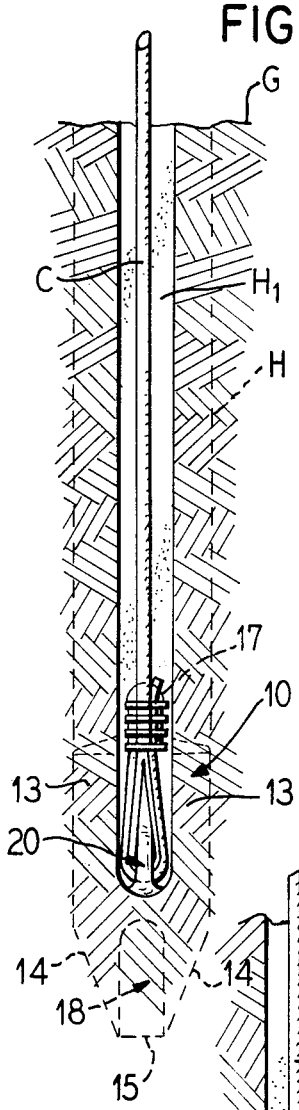
FIG. 8 is a view similar to FIG. 7, but taken 90 degrees therefrom to illustrate the front face of the anchor in the ground and the manner in which the ground flows around the ridge of the anchor.

As shown in FIGS. 7-10, the anchor 10 is driven vertically into the ground G by the driving tool T having its tapered end E loosely bottomed in the socket provided by the bore 25 in the trailing end of the anchor. As the anchor enters the earth or ground G, the sharp thin chisel edges of the leading edge 15 and tapered portions 14 of the wings 13 easily cut the ground causing the earth to flow through the channel 18 in the manner of a curved spade, driving plate of a post hole shovel or curved chisel. Since the bottom 19 of the channel is inclined toward the ridge 20, dirt will flow over the ridge creating a back pressure or load forcing the back face of the anchor against the portion of the earth lying opposite to the ridge 20. This keeps the anchor in an upright vertical position as it is being driven into the ground and also forms a channel or groove H in the small hole H formed by the anchor and the driving tool. This groove or notch H-1 in the hole H freely receives the cable C so that a free swinging action of the anchor 10 on the cable is maintained. A minimum amount of earth is displaced as the anchor is driven into the ground and the earth being moved flows smoothly through the channel 18 and over and around the ridge 20 as shown in FIGS. 7 and 8.

Figure 9:
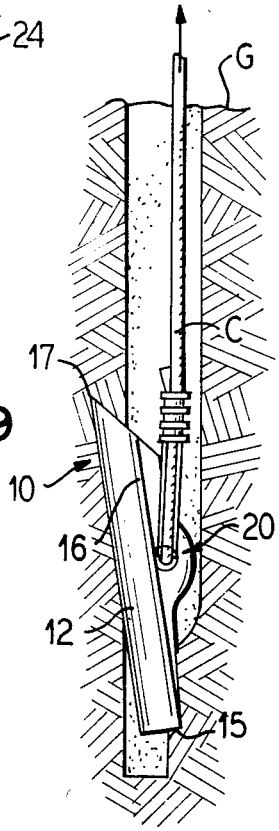
FIG. 9 is a view similar to FIG. 8 illustrating the start of the tilting of the anchor into the ground as the cable is tensioned.
Figure 10:
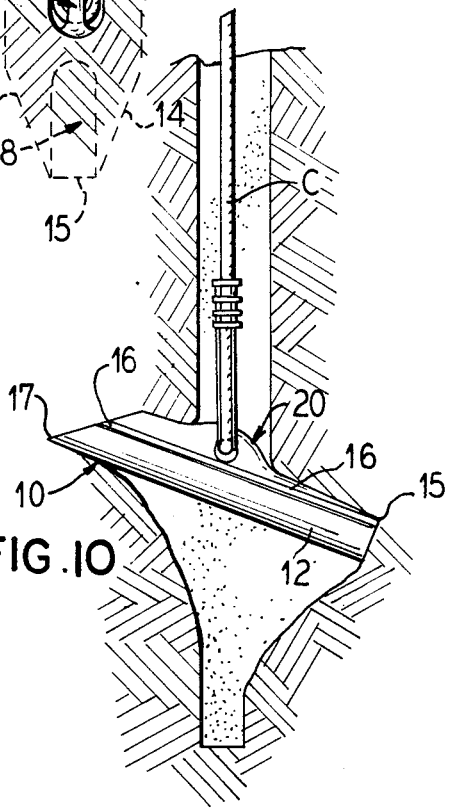
FIG. 10 is a view similar to FIG. 9 but illustrating the fully tilted lock position in the anchor in the ground.
Figure 11:
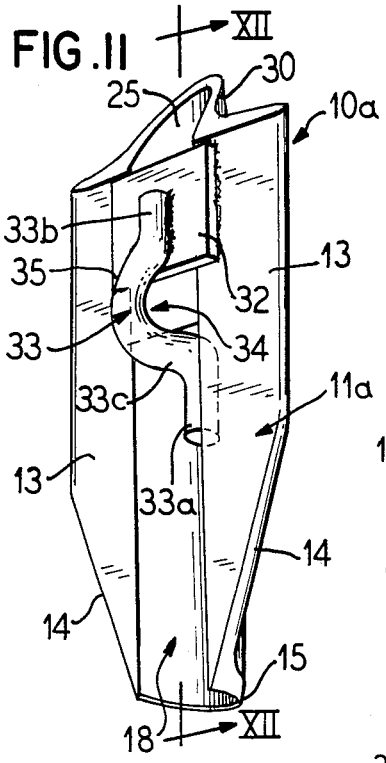
FIG. 11 is a front side and edge perspective view of a modified anchor of this invention.

When the anchor 10 has been driven to the desired depth in the ground, the driving tool T is removed from the socket provided by the bore 25 at the trailing end of the anchor and the cable is pulled upwardly as shown in FIG. 9. This upward pull of the cable causes the anchor to swing or tilt from its vertical position.

As shown in FIG. 9, the trailing chisel apex 17 and the trailing chisel edges 16 plow into the ground on one side of the hole while the chisel leading edge 15 and edges of the tapered portions 14 of the wing plow into the ground on the opposite side of the hole. The pivot swinging of the trailing edge 17 and the upward swinging of the leading edge 15 is continued until the anchor reaches a substantially horizontal or transverse position in the ground. In this position, the wide front face afforded by the wings 13 will underlie a large area of undisturbed packed ground to prevent the anchor from being pulled upwardly.

Since the edge-wise or upright contour of the anchor and the driving tool T only cut a small hole H, most of the ground area above the horizontally positioned anchor 10 remains undisturbed in its firm or hard packed original condition.

From these descriptions it will be understood to those skilled in the art that the anchor 10 is streamlined and contoured to offer little resistance to the ground as it is being driven into the ground in its edge-wise or upright condition and then when it is swung to its horizontal locking position, it offers maximum surface area to prevent it from being pulled out of the ground. At the same time, the contour is such that the tensioning cable is not fouled against its free swinging relation with the anchor to interfere with the tilting action of the anchor on the cable as it is swung to its locking condition.

The one-piece cast or forged anchor 10 of FIGS. 1–6 can also be made from bent or extruded steel or aluminum providing a modified anchor construction 10*a* of FIGS. 11–14. The modified anchor 10*a* has the same plate like body portion 11*a* as the anchor 10 with the leading chisel edge 15, channel 18, wings 13, and inclined open top socket 25. However, the longitudinal central body portion 12 of the anchor 10 becomes a hollow generally U-shaped rib 30 extending the full length of the anchor 10*a*, defining the channel 18 at its leading edge and the socket 25 at its trailing edge with a solid plug 31 anchored in the channel as by welding and the like to provide the bottom 26 for the socket and the trailing end of the channel bottom.

A flat cover plate 32 spans the open top of the channel 30 at the trailing ends of the wings 13 and is welded to the wings along its length thus forming a front closure or cover for the socket 25.

A rod 33 of a diameter fitting in the channel 18 has a leading leg portion 33*a* welded to the bottom of this channel 18 and a trailing leg 33*b* overlying and welded to the plate 32 with a curved intermediate portion 33*c* joining the legs and providing a transverse eye or aperture 34 for receiving the looped end of the cable C. This rod also provides the curving contour and crest 35 to perform the function of the ridge 20 in the anchor 10 embodiment of FIGS. 1–6. Thus, dirt entering the channel 18 will flow around forcing the back face of the anchor 10*a* against the earth on the opposite side of the hole and creating a channel freely receiving the cable C.

Figure 12:
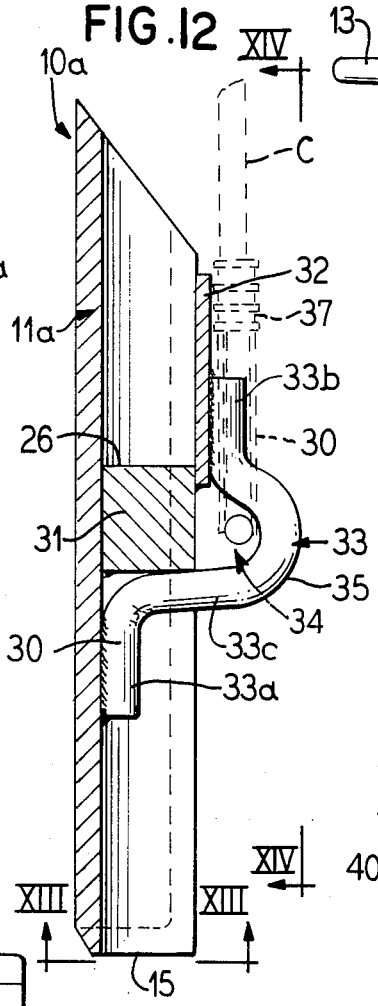
FIG. 12 is a cross-sectional view taken along the line XII—XII of FIG. 11 and also showing the cable swingingly mounted in the eye of the anchor.
Figure 13:
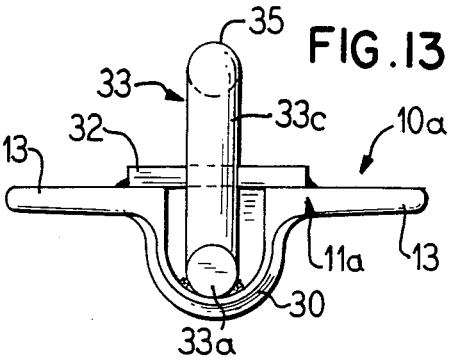
FIG. 13 is a leading end elevational view of the anchor of FIGS. 11 and 12 taken along the lines XIII—XIII of FIG. 12.
Figure 14:
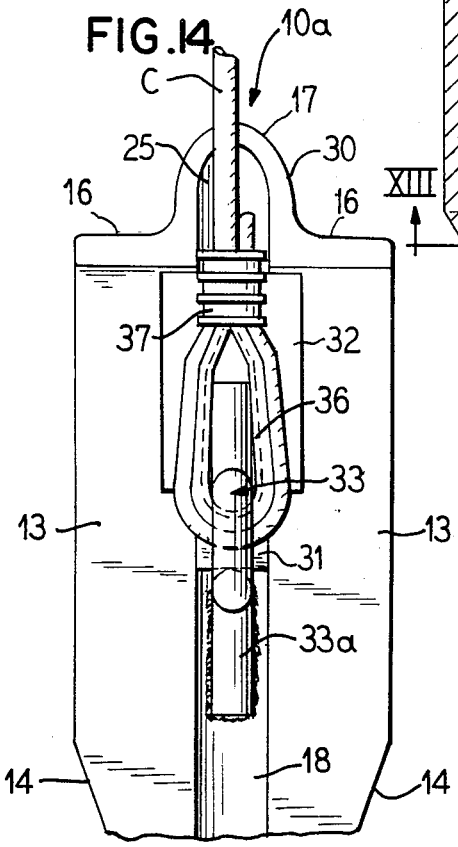
FIG. 14 is a front face of the cable anchor taken along the line XIV—XIV of FIG. 12.

As illustrated in FIGS. 12 and 14, the loop end of the cable C is seated in a thimble 36 and its free end is locked in a ferrule 37 to facilitate free swinging movement of the cable relative to the anchor 10*a*.

From the above description of FIGS. 11–14 it will be therefore understood that the modified anchor 10*a* functions in the same manner as the anchor 10, but is made by bending or extruding metal to form the main body thereof and has other components including the plug 31, plate 32 and ridge forming cable eye rod 33 welded thereto.

Figure 15:
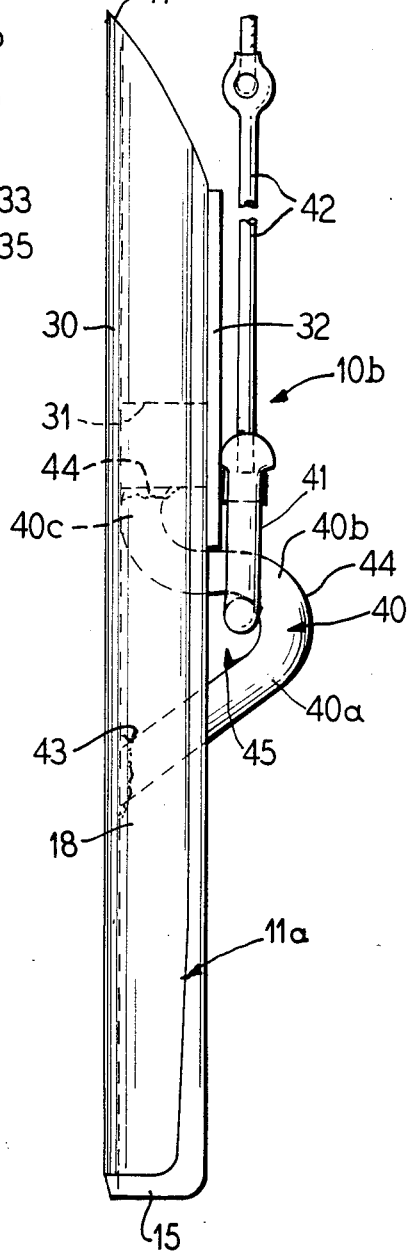
FIG. 15 is a side elevational view of a further modified anchor of this invention.

In the second modified embodiment of FIG. 15, a ground anchor 10*b* has the same body portion 11*a* as the anchor 10*a* with the same plug 31 and cover plate 32 components welded thereto. However, a modified eyelet rod 40 is provided especially shaped to swingably receive an eye hook 41 of an anchor rod 42. This rod 40 has an inclined leading leg 40*a* welded to the bottom of the channel 18 as illustrated at 43 and then sloping upwardly and rearwardly out of the channel to a crest 44 from which it descends back into the channel along its downwardly and rearwardly inclined leg portion 40*b* to a forwardly extending end 40*c* which is welded to the plug 31 and also to the bottom of the channel as illustrated at 44. This provides a large opening or eye 45 to freely receive the eye hook 41 on the end of the anchor rod 42. The anchor rod can replace the cable C. Alternately, of course, the cable C could be used with the free swing eye hook 41 or looped end of the cable as described in the anchor embodiments 10 and 10*a*.

The generally U-shaped through channel portion of the anchors 10*a* and 10*b* cooperating with the plug 31 and plate 32 provides a socket not only freely receiving the driving rod, but also provides gaps between the rod and the socket defining wall which will prevent dirt from being packed between the driving rod and socket thereby maintaining a free loose driving connection between the driving tool and the anchor.

It will be appreciated by those skilled in this art that many further embodiments are within the scope of this invention.

I claim as my invention:

1. An anchor for driving edgewise into the ground by an impact rod carrying an anchor line therewith which rotates the anchor to a flat position in the ground when tensioned which comprises an elongated plate-like member having a longitudinal central body portion with leading and trailing ends, an open top rod receiving socket in the traling end of said body portion, an open front channel at the leading end of said body portion, wings extending laterally from said body portion along the length thereof having tapered leading ends converging to the open front of the channel and trailing ends forwardly of the top of the socket leaving a portion of the socket projecting therebeyond, a raised longitudinal ridge on said body portion with a transverse eye therethrough, an anchor line having an end swingably looped in said eye, said channel discharging to said raised ridge, said ridge forming a groove in the ground alongside a driving rod bottomed in the socket for receiving said anchor line as the member is driven edgewise into the ground, said portion of the socket projecting beyond the wings being inclined longitudinally toward the trailing ends of the wings, and cutting edges on the wing ends and inclined socket portion whereby removal of the rod from the socket when the anchor has reached a desired depth in the ground and tensioning of the anchor line will rotate the member to its flat position to resist being pulled out of the ground.

2. The ground anchor of claim 1 wherein the plate-like member has a rear face with the body portion raised therefrom along the length thereof containing the socket.

3. The ground anchor of claim 1 wherein the plate-like member is formed in one piece.

4. The ground anchor of claim 1 wherein the plate-like member has a channel along the length thereof with a cover at the trailing end thereof cooperating therewith to provide the socket.

5. The ground anchor of claim 1 wherein the socket extends from one face of the plate-like member and the raised ridge extends from the other face thereof.

6. A ground anchor which comprises a generally rectangular plate member having a longitudinal central body portion along the length thereof with leading and trailing ends, an open front longitudinal channel at the leading end of the body portion, an open top longitudinal socket at the trailing end of the body portion, wings radiating from the body portion along the length thereof, a raised longitudinal ridge on the body portion between the wings communicating with the channel and the socket, said ridge having a transverse hole therethrough, an anchor line having an end swingably looped in said hole, said socket adapted to receive a rod to drive the member edgewise into the ground to a desired depth, said ridge forming a groove in the ground alongside said rod for receiving said anchor line, said channel holding said member in upright position as it is driven into the ground and flowing earth over said ridge away from said groove, and said anchor line rotating said member to a flat position in the ground when the rod is removed and the line is tensioned.

7. The ground anchor of claim 6 wherein the central body portion is a channel along the length of the rectangular plate member and a cover plate is affixed over the channel at the trailing end of the plate member to provide the socket.

8. The ground anchor of claim 6 wherein the raised ridge is a rod welded to the plate member.

9. The ground anchor of claim 6 wherein the open front channel extends the full length of the plate member, a cover is welded to the trailing end of the plate member to close the channel and provide the socket, and a plug is welded in the channel to provide the bottom of the socket.

10. The ground anchor of claim 6 wherein the longitudinal central body portion provides the socket on one face of the plate member and the raised ridge extends in a longitudinal direction from the other face of the plate member.

11. A ground anchor of the type driven edgewise into the ground by a driving rod and then rotated to a flat locking position by tensioning a cable swingably mounted thereon which comprises a rectangular metal plate having leading and trailing ends, a rear face between said ends with a thick longitudinally extending body portion, a front face between said ends having a scoop channel at the leading end and a raised longitudinally extending ridge downstream from the channel, said ridge having an eye extending transversely therethrough, a cable having an end swingably looped through said eye, the trailing end of said body having an open top driving rod receiving socket, laterally extending wings along the length of said body portion, and said channel directing earth over said ridge away from said front face to cooperate with the ridge for forming a groove in the ground receiving the cable.

12. The ground anchor of claim 11 including a tensioning member looped through the cable eye to swing freely.

13. The ground anchor of claim 11 wherein the plate member is bent from sheet metal.

14. The ground anchor of claim 11 wherein the plate member is cast metal.

15. A ground anchor comprising an elongated plate-like member having a longitudinal central body portion with leading and trailing ends, an open top socket at the trailing end of said body portion, an open front channel at the leading end of said body portion, wings extending laterally from said body portion along the length thereof having tapered leading ends converging to the leading end of the channel and trailing ends forwardly of the trailing end of the socket to leave a portion of the socket projecting therebeyond, a raised longitudinal ridge on said body portion with a cable receiving eye therethrough, said channel having an inclined bottom diverging to said raised longitudinal ridge, said portion of the socket projecting beyond the wings being inclined to cooperate with the wing ends in forming cutting edges in the trailing end of the member and said member adapted to be driven edgewise into the ground and rotated by a cable swingable in the eye of the ridge to a horizontal position to resist being pulled out of the ground.

16. A ground anchor which comprises a generally rectangular plate member having a longitudinal central body portion along the length thereof with leading and trailing ends, an open front longitudinal channel at the leading end of said body portion, an open top socket at the trailing end of said body portion, wings radiating from said body portion along the length thereof, a raised longitudinal ridge on the body portion between the wings having a leading end communicating with the channel and a trailing end communicating with the socket, said channel being U-shaped with a bight portion and side legs and having a sharp leading edge, said wings merging into the ends of the side legs, said bight portion sloping upwardly from the leading end edge of the channel to said raised ridge, said ridge having a transverse hole therethrough for receiving a tension member in free swinging relation, and said member offering minimum resistance when driven into the ground in an upright vertical position and offering maximum resistance when rotated into a flat position when pulled by said tension member.

* * * * *